US007588351B2

(12) United States Patent
Meyer

(10) Patent No.: US 7,588,351 B2
(45) Date of Patent: Sep. 15, 2009

(54) LED LAMP WITH HEAT SINK OPTIC

(75) Inventor: William E Meyer, Lincoln, MA (US)

(73) Assignee: Osram Sylvania Inc., Danvers, MA (US)

( * ) Notice: Subject to any disclaimer, the term of this patent is extended or adjusted under 35 U.S.C. 154(b) by 18 days.

(21) Appl. No.: 11/904,339

(22) Filed: Sep. 27, 2007

(65) Prior Publication Data

US 2009/0086492 A1 Apr. 2, 2009

(51) Int. Cl.
*F21V 29/00* (2006.01)

(52) U.S. Cl. ..... 362/294; 362/235; 362/650

(58) Field of Classification Search ..... 362/235, 362/241, 243, 268, 650, 294, 297; 700/83, 700/87

See application file for complete search history.

(56) References Cited

U.S. PATENT DOCUMENTS 6,948,829 B2 * 9/2005 Verdes et al. ..... 362/227
7,226,189 B2 * 6/2007 Lee et al. ..... 362/294
7,419,281 B2 * 9/2008 Porchia et al. ..... 362/253
2005/0174780 A1 * 8/2005 Park ..... 362/294
2006/0058712 A1 3/2006 Altshuler
2007/0109807 A1 5/2007 Lynam
2007/0159828 A1 * 7/2007 Wang ..... 362/294
2008/0106893 A1 * 5/2008 Johnson et al. ..... 362/228

* cited by examiner

*Primary Examiner*—John A Ward
(74) *Attorney, Agent, or Firm*—William E. Meyer

(57) ABSTRACT

An LED lamp may be made with a heat sink optic. The lamp has a base having a first electrical contact and a second electrical contact for receiving current. At least one LED is mounted on a thermally conductive support; that supports electrical connections for the LED and provides thermal conduction of heat from the LED to the optic. The LED support mounted in the base and electrically coupled through the first electrical contact to electrical current. The light transmissive, and heat diffusing optic has an external an internal wall defining a cavity with the LED positioned in the cavity. The optic is in thermal contact with the LED support and mechanically coupled to the base. The snap together structure enables rapid manufacture while allowing numerous variations.

24 Claims, 3 Drawing Sheets

LED LAMP WITH HEAT SINK OPTIC

TECHNICAL FIELD

The invention relates to electric lamps and particularly to electric lamps with LED light sources. More particularly the invention is concerned with an electric lamp with an LED light source and a heat sinking optic.

BACKGROUND ART

Efficient LED lamp designed to replace the standard incandescent lamp are rapidly moving to commercial production. An essential problem is heat sinking the LED's to increase the lumen output and to preserve the potentially very long life of the LEDs. Heavy metal heat sinks have been used along expensive and sometime awkward air cooled structures. These are heat sinks are impractical in ordinary use and add additional cost to the lamp for material and manufacturing costs. LED lamps are frequently being assembled by hand, which limits their reasonable market volume.

DISCLOSURE OF THE INVENTION

An LED lamp may be made with a heat sink optic. The assembly includes a base having a first electrical contact and a second electrical contact for receiving current. At least one LED is mounted on a thermally conductive LED support. The LED support has at least one electrical connection for the at least one LED and provides thermal conduction of heat from the at least one LED. The LED support is mounted in the base and electrically coupled through the first electrical contact to electrical current. A light transmissive, and heat diffusing optic has an external wall and an internal wall defining a cavity. The at least one LED is positioned in the cavity. The optic is in thermal contact with the LED support, and the optic is mechanically coupled to the base.

BEST MODE FOR CARRYING OUT THE INVENTION

Figure 1:
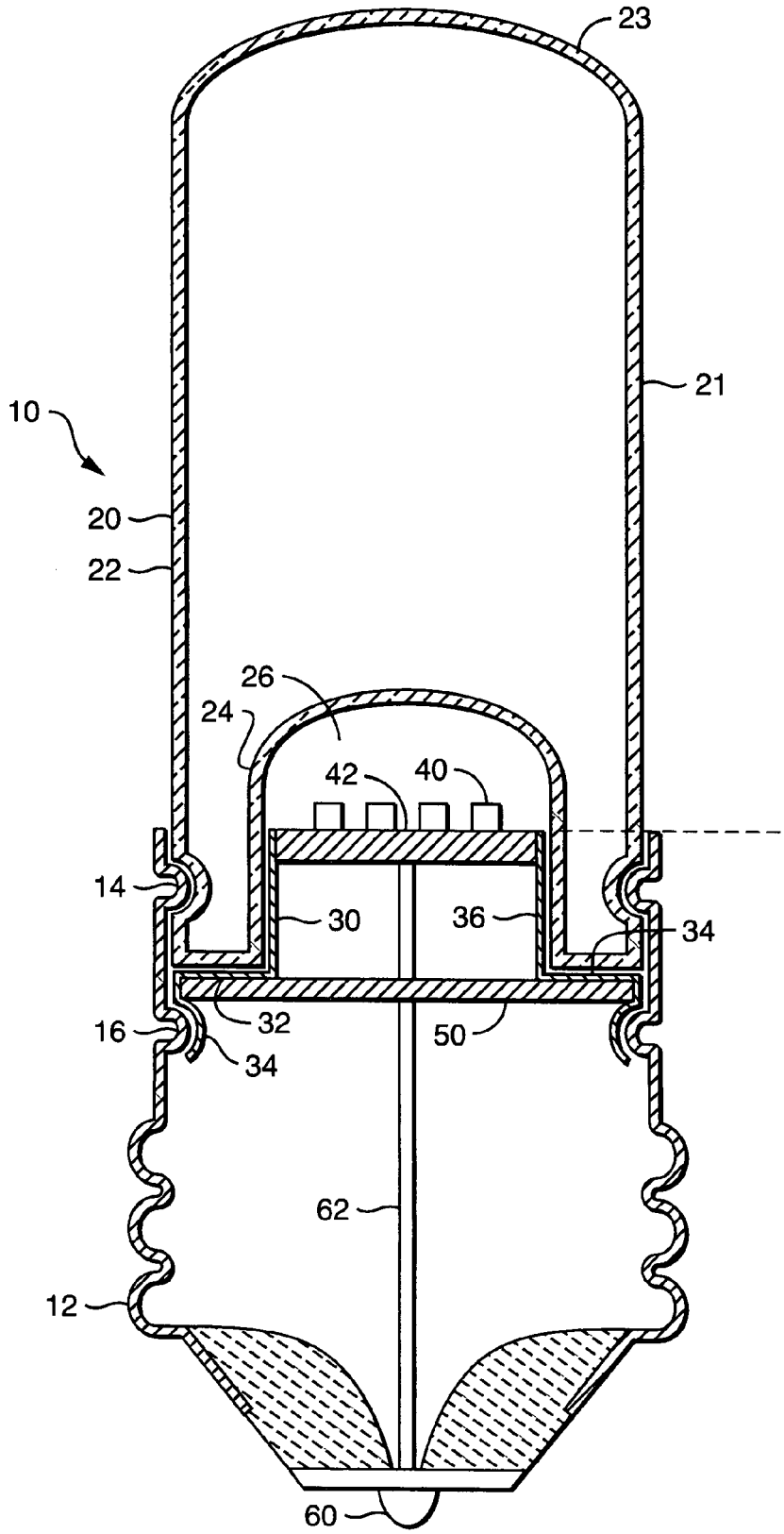
FIG. 1 shows a schematic cross sectional view of an LED lamp.

An LED lamp with a heat sink optic may be constructed from a base, an LED light source, an LED support, and a heat sinking optic.

The base may be constructed as a thread metal shell having a wall defining an interior volume. The base may be similar to those typically used in thread mounted incandescent lamp bulbs. The base includes a first electrical contact and a second electrical contact for receiving line current, and mechanical contacts for coupling to a corresponding electrical socket. In a preferred embodiment, the base includes three or more coupling points, such as indentations, defining a location plane against which the LED support may be positioned. A ledge, groove or step may also be formed in the base, against which an edge of the LED support may be positioned. The base may also include formed features to press against the LED support to position the LED support in tight thermal contact with the base or with heat sinking optic. The base may also be formed with positioning or latching features to securely mate with the heat sinking optic. For example, the base wall may include a ledge, step or groove or similar shaped portion to mate the base with an end edge, or side wall of the optic to accurately and securely locate the base with respect to the optic. The base may include a wall portion that over laps a portion of the optic where the optic includes an indentation or protuberance, so that the base wall may be correspondingly indented or protruded to mechanically mate with the optic. For example, the wall portion of the base may be include a step that axial mates with and locates on an edge end of the optic. An exteriorly over lapping portion of the base wall may then be pressed into a recess formed in the optic to secularly latch the base to the optic.

At least one LED is mounted on a LED support. The LED has electrical connections that may be powered to cause the emission of light from the LED. The LED may be a light emitting semiconductor chip for "chip on board" mounting or may be a typical LED assembly with a supporting lead frame, electrical connections, and an optional optic, such as a covering lens. It is understood that two or more LEDs may be alternatively used, and that the LEDs may provide the same or different colors. In general the at least one LED produces light which is optically guided by the optic to a field to be illuminated and heat which is thermally conducted by conduction and radiation away from the LED. It is only important that the LED light source, whether it is a LED chip or an LED assembly be thermally coupled to the support structure for thermal conduction away from the LED light source.

In the preferred embodiment, the at least one LED comprises one or more pairs of a first LED and a second LED. Each first LED and each second LED having a preferred direction of current operation, and each being electrically coupled in series with respect at least one other LED of a pair. One LED of each pair of LEDs is electrically coupled to a first electrical contact in a first current orientation with respect to line current and while the second LED of each pair of LEDs is electrically coupled in a second current orientation, opposite the first current orientation, to a second electrical contact. The second electrical contact is opposite to that of the first LED of the respective LED pair. In this way, the first LED and second LED pair may act as mutually rectifying current diodes for each other.

The LED support has at least one electrical connection for the at least one LED. The LED support is well coupled mechanically to the LED for good thermal conduction from the LED to the LED support. The preferred LED support includes one or more electrical connections for the LED. The electrical connection(s) may in fact be the mechanical connections providing the thermal connection to the LED support. The LED support may be a printed circuitry board, a metal plate with conductive traces, a thermally conductive ceramic or other thermally conductive support structure, generally planar in form supporting the LED or LEDs (chips or assemblies) as the case may be. The LED support may also support circuit features such as alternating to direct current conversion, voltage reduction, ballasting, over current or over voltage protections, switching, timing, or similar electrical features. The leads for the LED(s) may pass along the surface or may pass through formed holes in the LED support for electrical connection. The LED support may further include one or more positioning and coupling features such as a peripheral flange extending radially, or a peripheral wall extending axially that may be snuggly positioned against the optic or the base or both. For example, a peripheral wall may be radially extended as a disk to mate against a circular end wall edge of an optic. A peripheral wall may be radially extended as a disk to mate against a circular ledge formed on the optic. The peripheral wall may extend axially in a forward direction or a rearward direction to closely mate to the interior diameter of an inner wall of the optic. The peripheral wall may extend to mate with the end wall edge of the optic and overlap an exterior portion outside diameter of the optic exterior. A latch may be formed in the LED support, such as a protuberance or a recess, and the optic may be correspondingly formed, so the LED support and the optic may be snapped, latched or otherwise fitted and coupled one to the other. In these ways, the LED light source and LED support maybe easily and accurately inserted into, covered across or coupled around an end of the optic respectively as a plug insert, an end plate or snapped on cap. The preferred coupling provides accurate optical alignment of the LED with respect to the optic and secure thermal coupling to the optic for thermal conduction.

The LED support may alternatively be mounted in the base and electrically coupled through the first electrical contact to line current. For example, the LED support may be mounted on a step, ledge, spring clip or similar positioning feature formed on an interior side of the base wall. In this way the LED and LED support may be inserted into an open end of the base and electrically and mechanically coupled to the base. Heat may then be conducted from the LED support to the base wall. At the same time the base wall may be formed with a groove, step, ledge, guide wall, or other coupling feature to mechanically and thermally mechanically latched, snapped or otherwise coupled to the optic. The base may then be mounted to an interior wall of the optic, and end edge wall of the optic or an outer wall of the optic. In this way the base may be mechanically coupled to the optic, and heated may be conducted from the LED through the LED support to the base and optic.

In a preferred embodiment, the LED support includes a first contact in mechanical and electrical contact with the interior of an electrically conductive base wall. In a preferred embodiment, the LED support has a plurality of LEDs arranged in rows or rings on a LED support with a first electrical connection on one side of a first row or ring of LEDS, and an intermediate connection between the first row or ring of LEDs and a second row or ring of LEDs. A second electrical connection from a second side of the second row or ring of LEDS is made with the first row of LEDs and the second row of LEDs. The LEDs may be electrically oriented in reverse polarity.

A light transmissive, and heat diffusing optic is mechanically supported by the base and positioned to optically span the at least one LED. The preferred optic is formed from glass, quartz, polycarbonate, or a thermally conductive ceramic. There are a number of preferred light transmissive ceramics. Some have thermal conductivities greater than 30 watts per meter-Kelvin. These include aluminum nitride (AlN) (200 W/mK), which may be regular grained AlN (15-30 micrometer grains), submicron-grained AlN or nano-grained AlN. Sapphire (35 W/mK); alumina ($Al_2O_3$) (30 W/mK), submicron alumina (30 W/mK), or nanograined alumina (30 W/mK) may be used. Magnesium oxide (MgO) (59 W/mK) is also useful. There are advantages and disadvantages to each of these materials. Some have high transmissivities in the infrared range from 3 to 5 microns, which is approximately the peak radiation point of the typical LED chip's operating temperature of 300 K to 400 K. The better IR transmitters include aluminum nitride (AlN), alumina ($Al_2O_3$), and magnesium oxide (MgO). Spinel, AlON, YAG, and yttria are also transparent in the 3 to 5 micron range. Other ceramics such as spinel, AlON, YAG and Yttria are transparent in the visible, but have low thermal conductivity (less than 30 W/mK) and therefore are not as desirable as aluminum nitride (AlN), alumina ($Al_2O_3$), and magnesium oxide (MgO). Also, some materials such as YAG are not very transmissive (80% or less) in the IR range from 3 to 5 microns. The light transmissive heat sink further adds to cooling by radiating heat from the LED junction, which is absent, or limited in the case of a plastic or glass optic. The preferred light transmissive heat sink materials are therefore good at further reducing self-heating by allowing enhanced IR radiation, and in particular have a transmission greater than 80 percent in the IR region of from 3 to 5 microns. Other materials have lower indexes of refraction than the associated dies have, and thereby encourage light extraction from the LED die. The Applicants prefer aluminum nitride for thermal conductivity and for a thermal coefficient of expansion well matched to that of many LED chips. Nano-grained or submicron grained alumina is preferred for thermal conductivity and for transparency. Alumina in differing forms is preferred for manufacturing cost. Magnesium oxide is preferred for optical transmission and for a low refractive index.

The optic may include an input window at a first end, an intermediate light guide portion with an internally reflective surface, and an output window at a second end. The input window and output windows may include refractive features to develop a preferred distribution of the emitted light. The ends may be axially opposed one to the other. The optic may include a light diffusing exterior surface on some or the entire surface. The optic may include a light reflecting coating, such as a metallization, or interference coating, on some or the entire exterior surface to shape or direct the output light pattern. The optic may include a light filtering coating, such as a thin metallization, absorption coating or interference coating, on some or the entire exterior surface to filter or color or color pattern the output light. The optic may include on an interior surface, an end edge wall or exterior wall, one or more recesses or protuberances to mechanically mate with either the LED support or the base or both to mechanically align the LED with the optic, to thermally couple the LED through the LED support to the optic and to mechanically couple the base to the optic to enable threading of the whole assembly in to a socket. In one preferred embodiment, the optic includes a formed core recess to enclose the LED. The volume of the core recess may be filled with a light transmissive potting material, such as a silicone material as known in the art thereby providing further thermal coupling from the LED to the optic. The potting material; may include diffusion materials or colorant materials.

In one preferred embodiment, the optic includes a mechanical coupling for mating with the base. For example an interior surface or the exterior surface of the optic may include a ledge, groove or recess, to which a correspondingly shaped piece of the support or base may be tightly fitted by spring fitting, peening, gluing or similarly joining the fitted pieces.

In one preferred embodiment, the optic includes a formed recess mechanically coupled to a mechanical protrusion of the support of the LED. In one preferred embodiment, the optic includes a formed protrusion, mechanically coupled to a mechanical recess of the support of the LED.

In one preferred embodiment, the optic includes at least one light refractive element. The refractive elements may be a smooth single surface, a plurality of lenticules, or facets, or Fresnel edges, ribs or arranged circularly, axially or diffusely.

In one preferred embodiment, the optic includes at least one refractive band extending around the optic. In one preferred embodiment, the optic includes at least one refractive facet on the end of the optic. In one preferred embodiment, the optic includes at least one refractive band extending axially along the optic.

In one preferred embodiment, the optic has a diffusing surface intermediate the at least one LED and the optic. In one preferred embodiment, the diffusing surface is formed as a portion of the optic. The diffusing surface may be mechanically formed by etching, grinding or similar abrading or altering the surface or by coating the surface with a diffusing material. In one preferred embodiment, the diffusing surface is a separate body intermediate the optic and the at least one LED. For example a diffusing plate, diffusing filler, or diffusing potting may be inserted intermediate the LEDs and the optic. For example, a diffusing plate may be mechanically or frictionally engaged with an interior surface of the optic to intercept all or most of the light transmitted form the LED toward the optic. In the same fashion, a coloring layer may be inserted intermediate the LED and the optic to filter or color the emitted light. Alternatively the diffusing layer may be suspended over the LED from the LED support. It is understood the intermediate layer may be diffusing, coloring (e.g. phosphor coated), filtering or any combination thereof. In a preferred embodiment, the diffusing surface is formed as a portion of the least one LED. It is understood that in an LED assembly the exterior cover lens may be diffusing, coloring (e.g. phosphor coated), or filtering.

In a preferred embodiment, the optic comprises a cylindrical light guide optically coupled at a first end to the one or more LEDs and having a second end including a refractive element facing a field to be illuminated. In a preferred embodiment, the optic is formed from a light transparent ceramic selected from the group including: glass, quartz, polycarbonate, and acrylic. There are a number of preferred light transmissive ceramics that have thermal conductivities of 30 watts per meter-Kelvin or more. These include aluminum nitride (AlN) (200 W/mK), including regular grained AlN (15-30 micrometer grains), submicron-grained AlN or nano-grained AlN; sapphire (35 W/mK); alumina (Al2O3) (30 W/mK), submicron alumina (30 W/mK), or nanograined alumina (30 W/mK); or magnesium oxide (MgO) (59 W/mK). Each of these materials has advantages and disadvantages. Some of the light transmissive heat sink materials are also highly transmissive in the infrared range from 3 to 5 microns, which happens to be the approximate peak radiation point of the usual LED chip temperature operating range of 300 K to 400 K. The better IR transmitters include aluminum nitride (AlN), alumina (Al2O3), and magnesium oxide (MgO). Spinel, AlON, YAG, and yttria are also transparent in the 3 to 5 micron range. Other ceramics such as spinel, AlON, YAG and Yttria are transparent in the visible, but have low thermal conductivity (less than 30 W/mK) and therefore are not as desirable as aluminum nitride (AlN), alumina (Al2O3), and magnesium oxide (MgO). Also, some materials such as YAG are not very transmissive (80% or less) in the IR range from 3 to 5 microns. The light transmissive heat sink then adds an additional cooling mechanism by radiating heat from the junction, which is absent in the case of a plastic or glass, lens or window. The preferred light transmissive heat sink materials are therefore good at further reducing self-heating by allowing enhanced IR radiation, and in particular have a transmission greater than 80 percent in the IR region of from 3 to 5 microns. Other materials have lower indexes of refraction than the associated dies have, and thereby encourage light extraction from the LED die. The Applicants prefer aluminum nitride for thermal conductivity and for a thermal coefficient of expansion well matched to that of many LED chips. Nano-grained or submicron grained alumina is preferred for thermal conductivity and for transparency. Alumina in differing forms is preferred for manufacturing cost. Magnesium oxide is preferred for optical transmission and for a low refractive index.

In one preferred embodiment, light transmissive coupling material is in intimate contact with the at least one LED and with the optic. In one preferred embodiment, the LED support includes a center contact in electrically contact with a center contact of the base.

In one preferred embodiment, the optic includes an internal ledge to position the LED support. In one preferred embodiment, the optic includes a curved face radial of the plane of the LED positions. The curved surface has a reflective exterior coating and an optical curve to reflect light emitted radially from the LED(s) in a forward direction, substantially parallel to the lamp axis. Alternatively the reflective exterior coating reflects the radially emitted light at an angle to the lamp axis providing a cone of emitted light. In one preferred embodiment, the optic includes an internal coupling to latch with the base.

FIG. 1 shows a schematic cross sectional view of an LED lamp 10. The lamp 10 comprises a threaded base 12 formed from a tubular metal shell similar to the typical Edison lamp base. As shown, the base 12 may include a first latch 14 and a second latch 16 formed along upper end of the metal side wall. The preferred first latch 14 comprises one or more indentations. The second latch 16 may similarly comprise one or more indentations. It is understood the latches described here may be male/female inverted to be protrusions. Alternatively a groove and rib or spline type couplings may be used. Other latching structures may also be used. The optic 20 comprises a heat conductive, light transmissive material with an external wall 22 and an internal wall 24 defining a cavity 26. The external wall 22 may be formed to be smooth, or curved so as to provide a desired refractive aspect or detailed with facets, lenticules, frosted or similar refracting or diffusing features. As show, optic 20 includes an upper portion with a cylindrical side wall 21 with total internal reflection, and convex lens 23 formed on the axial end. The exterior wall 22 is formed with latch features to couple with indentations designed to mate with the first latch 14 of the base 12. The base 12 and optic 20 may then be snuggly mated to together. Alternatively glue may be used to bond the base 12 to the optic 20. The support 30 may be a cylindrical metal platform having a skirt 32 including latching indentations that mate with the second latch 16 of base 12. The skirt 32 also includes a ledge 34 and sidewall 36 portion that snuggly mate to the end faces of the optic 20. The support 30 may be in the form of a tube with an open upper end supporting an LED light source 42 in the open end as a plugged in element or the support 30 may be a closed end tube supporting the LED light source 42 along the top (upper) face of the closed end tube. The side wall 36 of the support 30 and the interior wall of the optic 20 are sized and shaped to snuggly fit together, for example as tubular sections with closely telescoping respective inner and outer diameters. The close fit enables good heat conduction from the support 30 to the optic 20. The LEDs 40 may be mounted on an LED light source 42 that comprises a thermally conductive plate mounted in the end of the support 30. The skirt 32 and side wall 36 of the support 30 are sized to enable proper depth insertion of the support 30 into the cavity 26. The ledge 34 of the skirt 32 then blocks the end wall of the optic 20. The LED light source 42 may be a thermally conductive ceramic, a printed circuit board, a metal body with appropriate electrically insulating layers or similarly appropriate mechanical support for enabling electrical connection of the LEDs 40 while providing good thermal conduction from the LEDs 40 to the support 30, and optic 20. The LED support 42 may include circuitry for controlling or operating the LEDs 40. The LEDs 40 are mounted to face outwards to direct light through the optic 20. In the preferred embodiment the LEDs 40 are extended into the cavity 26 to be at or above the level (dotted line) of the end of the side wall of the base 12 so that light emitted sideways from the LEDs 40 is not blocked by the first latch 14 or the adjacent end portion of the side wall of the base 12. The lamp 10 may optionally include additional circuitry to electrically operate the LEDs 40. For example, a circuit plate 50 may be positioned in the base 12 cavity 26 between the LED light source 42 and the end contact 60 of the base 12. As shown, a circular second circuit plate 50 may be positioned, for example pinched or clipped, between the lower side of the skirt 32 and the second latch 16. The lamp 10 may be assembled by joining the LED light source 42 and the support 30. The second circuit board 50, if any may be snapped in place on the bottom side of the support 30. The LED light source 42 and support 30 may then be loaded into the cavity 26 of the optic 20. The base 12 is then applied by latching the first 14 and second 16 latches. Electrical connections are made as in Edison lamps. The side wall of the base 12 is electrically coupled through the support 30 (or the second circuit board 50) to LED light source 42 (or directly to the LED 40 connections). The end contact 60 of the base 12 is electrically coupled through a center lead 62 to the LED light source 42 (or indirectly through the second circuit 50.) The snug snap fit of the assembly enables rapid assembly and good heat conduction from the LEDs 40 and LED light source 42 to the optic 20 and base 12.

Figure 2:
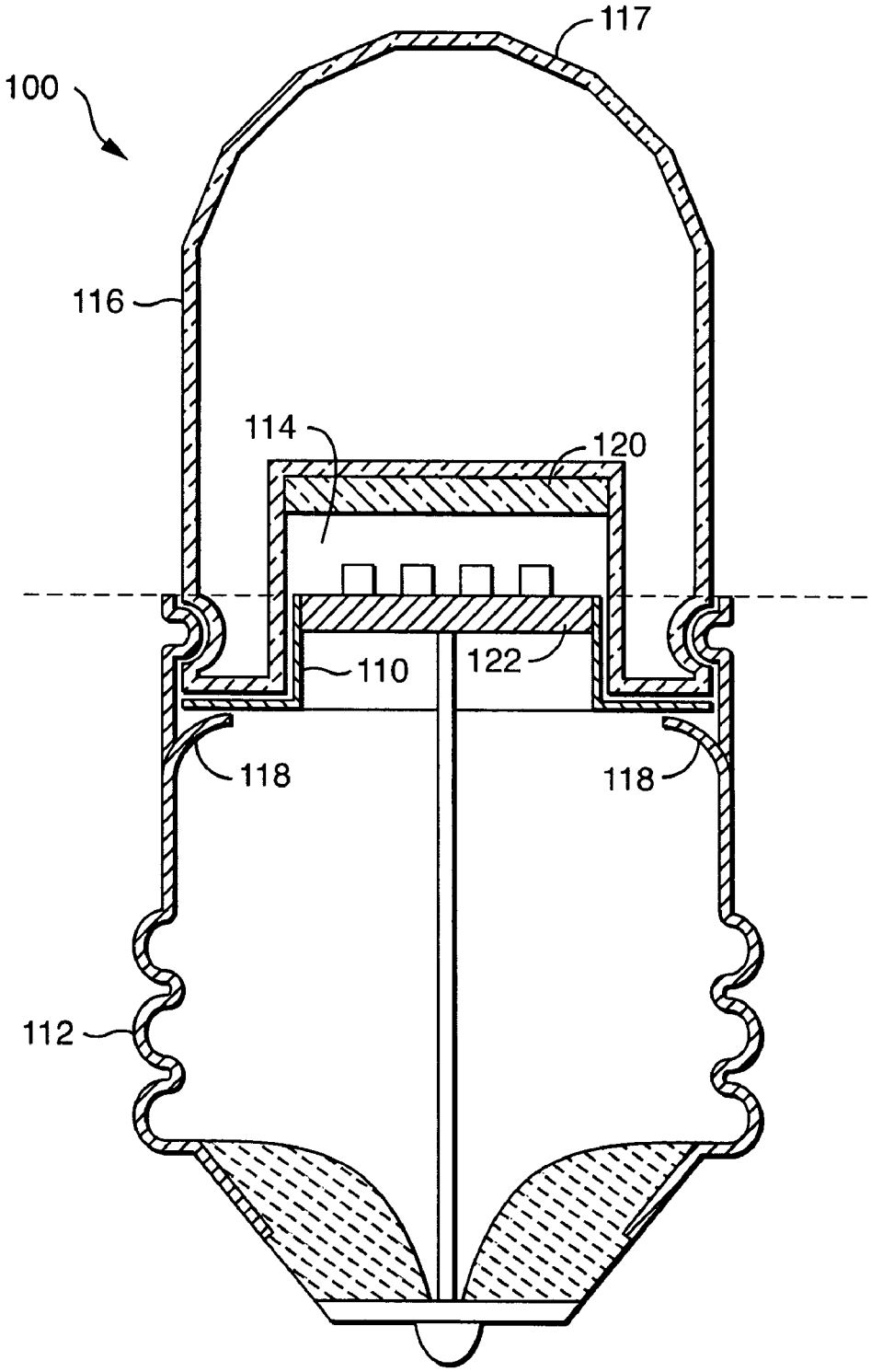
FIG. 2 shows a schematic cross sectional view of a further alternative LED lamp

FIG. 2 shows a schematic cross sectional view of an alternative LED lamp 100. The LED support 110 need not latch to the base 112. The support 110 may be fitted in the cavity 114 formed in the optic 116 and substantially retained in place by the friction of a snug fit. Instead of a second latch, the base 112 may be formed with spring tabs 118. The spring tabs 118 extend from the side wall of the base 112 to contact the support 110 and press the support 110 into position with the optic 116. The spring tabs 118 may simultaneously form one of the electrical contacts between the base 112 and the support 110. The base 112 is otherwise latched the exterior of the optic. A light altering element 120 may also be placed in the cavity 114 between the LED light source 122 and light exit path through the optic 116. The light altering element 120 may be a phosphor doped or coated glass, plastic or similar optical element or similarly colored optical element. Alternatively the light altering element 120 may be a light diffuser. Alternatively the light altering element 120 may be a phosphor or similar light color altering or light diffusing coating. It is convenient to have replaceable colored inserts or coatings placed in or formed on inner surface of the optic 116. The same standard components may then be used to make a variety of differently color lamps. It is understood the interior surface of the optic may be etched, or coated to form the light altering element 120. The optic 116 may also be formed with facets, or similar refractive elements 117 on the exterior surfaced.

Figure 3:
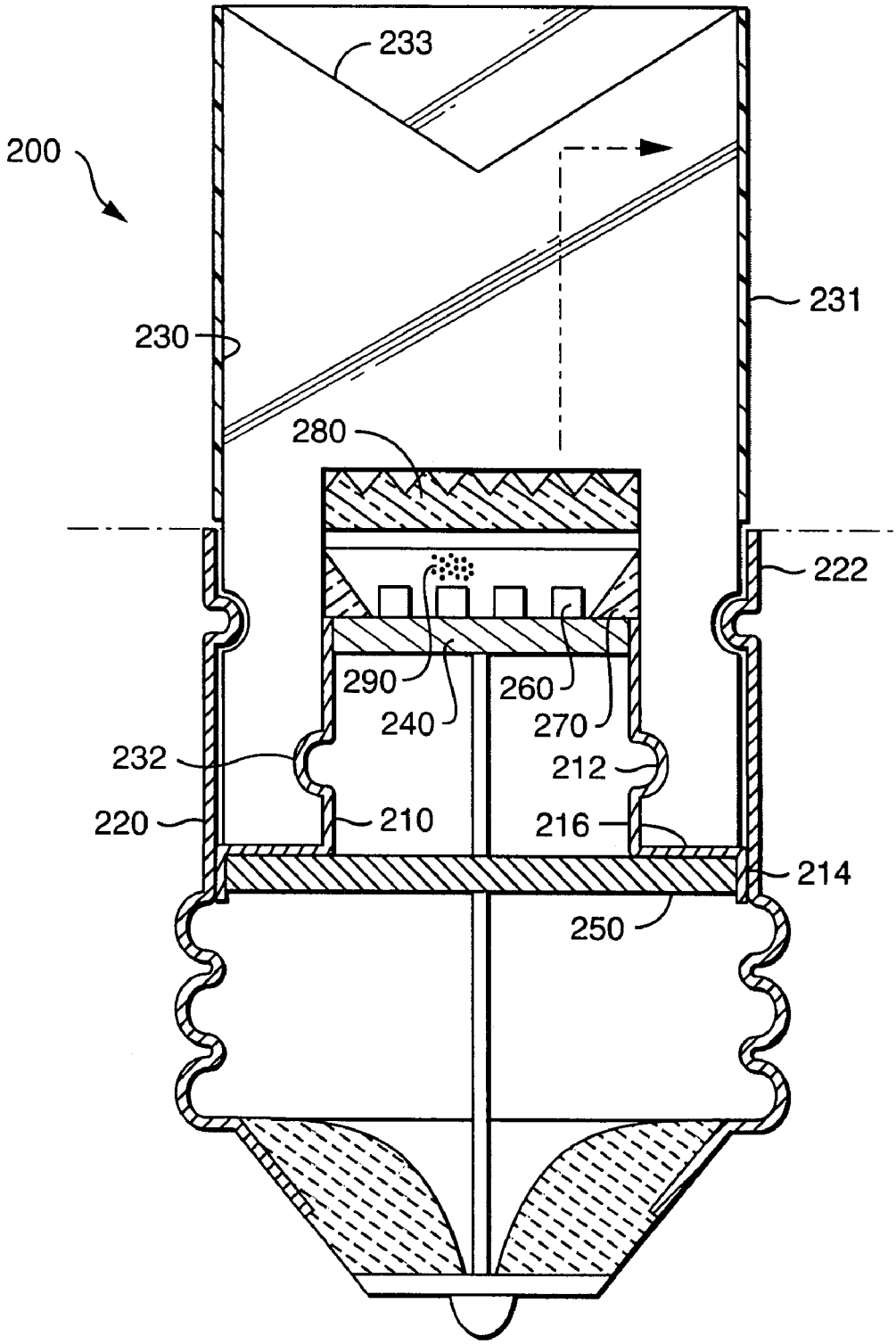
FIG. 3 shows a schematic cross sectional view of a further alternative LED lamp.

FIG. 3 shows a schematic cross sectional view of a further alternative LED lamp 200. The LED support need not latch to the base. The LED support 210 may include latch features 212 to mate with the interior of the optic 230. For example, indentations 232 may be formed on the interior wall of the optic 230, and the side wall of the support 210 may include corresponding features 212 to couple the support 210 to the interior wall of the optic 230. The optic 230 as shown may include an outer end with a surface coating 231 that may be a filter, colored or diffusing and a side deflecting end reflector 233. It is again convenient to use a skirt 214 and ledge 216 structure to properly locate the LED light source 240 optically in the depth of the cavity. The skirt 214 may extend to electrically contact the side wall of the base 220 for one of the LED electrical connections and of course for thermal conduction from the support 210 to the base 220. The optional second circuit plate 250 may be positioned in the lower skirt 214 region. Intermediate the LEDs 260 and the optic 230 an optional side optic 270 may be included on the support, such as ring shaped prism or reflector. Where the side emission of LEDs 260 is adequately intercepted by the side optic 270, the side wall 222 of the base 220 may be extended farther up the side of the optic 230 for thermal conduction. The interior of the cavity in the optic 230 may also optionally include a light refracting element 280, such as an inserted Fresnel lens positioned intermediate the LEDs 260 and the light exit path through the optic 230. The cavity in the optic 230 may also be filled with a sealant 290 intermediate the LEDs 260 and the interior wall of the optic 230. Silicone fills are known in the art for this purpose. The sealant 290 may include phosphors, other colorants or light diffusing materials.

The snap together construction allows for rapid manufacture while addressing heat sinking and the need for numerous variations in color, diffusion, and beam spread. While there have been shown and described what are at present considered to be the preferred embodiments of the invention, it will be apparent to those skilled in the art that various changes and modifications can be made herein without departing from the scope of the invention defined by the appended claims.

What is claimed is:

1. An LED lamp with a heat sink optic comprising:

a base having a first electrical contact and a second electrical contact for receiving current;

at least one LED mounted on a thermally conductive LED support;

the LED support having at least one electrical connection for the at least one LED and providing thermal conduction of heat from the at least one LED;

the LED support mounted in the base and electrically coupled through the first electrical contact to electrical current; and a light transmissive, and heat sink optic having an external wall and an internal wall defining a cavity, the at least one LED positioned in the cavity, the optic being in thermal contact with the LED support and diffusing heat from the at least one LED, the optic being mechanically coupled to the base.

2. The lamp in claim 1, wherein a light transmissive coupling material is in intimate contact with the at least one LED and with the optic.

3. The lamp in claim 1, wherein the optic includes at least one light refractive element.

4. The lamp in claim 1, wherein the optic includes a mechanical coupling for mating with the support of the at least one LED.

5. The lamp in claim 1, wherein the optic includes at least one refractive element formed on the exterior wall of the optic.

6. The lamp in claim 1, having a light diffusing element intermediate the at least one LED and the optic.

7. The lamp in claim 6, wherein the diffusing element is formed on a portion of the optic.

8. The lamp in claim 6, wherein the diffusing element is a separate body intermediate the optic and the at least one LED.

9. The lamp in claim 6, wherein the light coloring element is formed on a portion of the optic.

10. The lamp in claim 6, wherein the light coloring element is a separate body intermediate the optic and the at least one LED.

11. The lamp in claim 6, wherein the light deflecting element is a light refracting element.

12. The lamp in claim 6, wherein the light refracting element is a lens.

13. The lamp in claim 6, wherein the light deflecting element is a light reflecting element.

14. The lamp in claim 1, having a light coloring element intermediate the at least one LED and the optic.

15. The lamp in claim 1, having a light deflecting element intermediate the at least one LED and the optic.

16. The lamp in claim 1, wherein the LED support includes a first electrical contact in electrical contact with the base wall.

17. The lamp in claim 1, wherein the LED support includes a center contact in electrically contact with a center contact of the base.

18. The lamp in claim 1 wherein the optic is a light transmissive plastic such as polycarbonate plastic.

19. The lamp in claim 1 wherein the LED support includes a skirt portion in close mechanical contact with the optic.

20. The lamp in claim 19 wherein the skirt portion sets the axial positioning of the LED support with respect to the optic.

21. An LED lamp with a heat sink optic comprising:

a base having a first electrical contact and a second electrical contact for receiving current;

at least one LED mounted on a thermally conductive LED support;

the LED support having at least one electrical connection for the at least one LED and providing thermal conduction of heat from the at least one LED;

the LED support mounted in the base and electrically coupled through the first electrical contact to electrical current; and a light transmissive, and heat sink optic having an external wall and an internal wall defining a cavity, the at least one LED positioned in the cavity, the optic being in thermal contact with the LED support and diffusing heat from the at least one LED, the optic being mechanically coupled to the base, and wherein the optic comprises a cylindrical light guide optically coupled at a first end to the one or more LEDs and having a second end including a refractive element facing a field to be illuminated.

22. The lamp in claim 21, wherein the optic is formed from a light transparent ceramic selected from the group including: glass and quartz.

23. The lamp in claim 21, wherein the optic is formed from a light transparent ceramic selected from the group including: aluminum nitride (AlN), sapphire, alumina ($Al_2O_3$), and magnesium oxide (MgO).

24. The lamp in claim 21, wherein the optic is formed from a light transparent ceramic selected from the group including: spinel, AlON, YAG, and yttria.

* * * * *